US006691864B1

(12) United States Patent
Capo

(10) Patent No.: US 6,691,864 B1
(45) Date of Patent: Feb. 17, 2004

(54) WRAP-AROUND PACKAGES

(75) Inventor: James L. Capo, Middletown, OH (US)

(73) Assignee: Rock-Tenn Company, Norcross, GA (US)

( * ) Notice: Subject to any disclaimer, the term of this patent is extended or adjusted under 35 U.S.C. 154(b) by 54 days.

(21) Appl. No.: 10/006,488

(22) Filed: Dec. 6, 2001

(51) Int. Cl.[7] ..... B65D 69/00

(52) U.S. Cl. ..... 206/223; 206/763; 206/770; 229/120.18

(58) Field of Search ..... 206/763, 769, 206/499, 765, 766, 485, 486, 581, 476, 590, 756, 223, 770, 434, 775, 776, 777; 229/103.2, 104, 120.02, 120.08, 120.11, 120.12, 120.18, 120.23, 120.24

(56) References Cited

U.S. PATENT DOCUMENTS 2,139,534 A * 12/1938 Williamson ..... 229/102.5
2,320,396 A * 6/1943 Ringler ..... 206/455
2,464,951 A * 3/1949 Stengren ..... 206/765
2,700,456 A * 1/1955 Gillam ..... 206/777
2,744,622 A * 5/1956 Sparks ..... 206/777
2,860,824 A * 11/1958 Guyer ..... 229/103.2
3,692,228 A * 9/1972 Spiegel ..... 206/486
4,848,563 A * 7/1989 Robbins ..... 206/315.9
4,925,087 A * 5/1990 Ostrander ..... 229/120.03
5,465,834 A * 11/1995 Sieber et al. ..... 206/193
5,611,431 A 3/1997 Harris
5,626,284 A 5/1997 Franzen
5,765,693 A 6/1998 Gnadt et al.
5,813,523 A * 9/1998 Gnadt et al. ..... 206/77.1
5,896,996 A * 4/1999 Chuang ..... 206/769
5,948,308 A 9/1999 Wischusen, III
5,984,086 A 11/1999 Foushee et al.
5,992,630 A 11/1999 Brown et al.
6,024,224 A 2/2000 Gnadt et al.
6,089,369 A * 7/2000 Markey ..... 206/349

* cited by examiner

*Primary Examiner*—Shian Luong
(74) *Attorney, Agent, or Firm*—Kilpatrick Stockton LLP

(57) ABSTRACT

A wrap-around package that exposes the products within, but provides sufficient space for marketing and advertising materials. The wrap-around package comprises at least two container-receiving structures and a central compartment for display of a washing aid or other accessory. The package is formed from a base sheet having a plurality of fold-lines that define a plurality of panels. A method for forming a wrap-around package is also disclosed.

21 Claims, 4 Drawing Sheets

WRAP-AROUND PACKAGES

BACKGROUND OF THE INVENTION

1. Field of the Invention

This invention relates generally to packages and methods for making packages for shipping and carrying multiple containers and a related accessory.

2. Background

Packaging of products serves numerous purposes. For example, one of the most important roles of packaging is to protect products during shipping from impact and/or aggressive environments. Packaging, as a general matter should be efficient; it should occupy a minimum amount of space and require minimal and cost effective materials and structure.

Another essential role for packaging is marketing and advertising. Displayed side by side with its competition in the supermarket or sales outlet, the product with the most appealing package is likely to be the consumer's choice. A product's packaging, along with its price, and the style of its advertising, contributes to its overall "image" in the mind of the consumer. The success of a marketing campaign frequently depends on this deliberate creation of an image.

More recently, there has been a trend to reduce the amount of packaging materials used due to environmental concerns. Environmental issues have also affected the content of packaging materials. For example, many manufacturers would like to use and consumers would like to buy products in recycled or recyclable packaging.

Thus, it is desirable to provide convenient packaging of products that is eye-catching to the consumer, while maintaining cost-effectiveness and environmental consciousness. A popular type of packaging that may be adapted to meet these needs is wrap-around packaging.

Wrap-around packaging surrounds only a portion of its contents such that another portion remains visible. Wrap-around packaging is superior to box-type containers in several respects. One advantage is that it requires less material to produce. Another advantage is that wrap-around packaging permits the manufacturer to display a portion of the contents, making them visible and more appealing to the consumer, thus increasing sales leverage.

A drawback of wrap-around packaging is that it often lacks the structural integrity of box-type packages. Package manufacturers have addressed this problem in various ways. For example, some wrap-around packages rely on the interrelation of the containers themselves to partially support the package. Another solution is to limit wrap-around packaging to use with lighter containers or to packages made to hold and display fewer containers. Alternatively, the wrap-around package may include a stiffening apparatus to provide additional support. However, including a stiffening apparatus adds bulk to the wrap-around package.

Another problem with wrap-around packaging is that many wrap-around packages obscure the products within almost completely. These types of packages also require a larger amount of fiberboard or other materials used to make the package. Extensive printing on such packages is necessary to advertise or market the packaged products, as they are not readily visible to consumers.

Wrap-around packaging designed to use less material and to display the products contained within often leaves only a limited area on the package for product markings. This places more emphasis on the markings of the products themselves, which may be partially obscured by the packaging. Other wrap-around packages rely primarily on the products themselves for markings. For example, a C-clamp package is known that allows the products within to remain highly visible when shrink-wrapped, but the area available for markings is limited. There is, therefore, a need in the art for a wrap-around package that allows the contained products to be viewed by consumers and sufficiently contains multiple products, while also providing a sufficient area for markings or graphics.

Manufacturers who desire to use wrap-around packaging to package disparately shaped products are at a particular disadvantage. The packaging may need to be designed to hold taller and shorter items or soft and hard items, for example. In the personal care industry, where packaging is particularly important for marketing, this is often a concern. Manufacturers hoping to pair a new product with a well known product and market the set must be able to package the two together. An example of a common pairing in the personal care industry is beauty products paired with a related accessory.

For example, in the personal care industry, aids to personal washing are well known. Common examples of washing aids are a washcloth, a loofah and textured gloves. A more recent type of washing aid is a puff. A puff is made of a mesh-like plastic material and is spherically shaped. Puffs are typically used in conjunction with a body wash. Body washes represent a new method of cleaning the body that can provide cleansing and moisturizing in one step. Body washes are used by applying a dab of liquid cleanser on a puff. The puff creates a creamy lather when massaged onto the body. The puff allows water and air to mix with the body wash, which can then be applied to the entire body. Cleansing agents in the lather remove dirt, while the moisturizers in the formula remain in suspension. As water rinses the lather away, the moisturizers are deposited on the clean skin and absorbed.

This type of personal washing has become increasingly popular. Manufacturers are able to incorporate scents and moisturizing agents into body washes to suit the particular needs of consumers. Body washes may also be marketed to a broad range of customers. For example, body washes may include ingredients suited to particular skin types. They may be marketed to children as a way to make bathing more fun. As body washes typically are used with a puff, it is desirable to sell both the puff and the body wash together. Other personal care products lend themselves to multiple product packaging. For example, body powder may be packaged with a powder puff; baby wash may be packaged with a washcloth; shampoo and conditioner may be packaged with a brush. The possibilities are numerous, but there is not a suitable packaging product that is currently provided that meets these multiple product needs.

Devising a package suitable for dissimilarly shaped products such as these presents a challenge to the packaging developer. First, it is desirable that both products be visible to the consumer. Second, it is desirable to minimize packaging materials, for both environmental and cost reasons. Finally, it is important that the packaging materials provide sufficient support to the products during shipping.

The use of wrap-around packaging with items such as a puff, powder puff, washcloth or similar accessory presents a particular problem because of the inability of the accessory to provide support for the package. Wrap-around packages using shrink-wrap to impart support to the packaging are known. This has the effect of displaying the accessory. However, shrink-wrap is susceptible to punctures. Known packages surrounding a puff with shrink-wrap risk the puff or other accessory being separated from the package during transit. Additionally, theft of the accessory is more likely where the surround is entirely comprised of shrink-wrap. Thus, there is a need in the art for a wrap-around package that effectively displays a puff or other accessory while reducing the risk of theft, damage or separation in transit.

SUMMARY

The present invention relates to wrap-around packages that can display differently shaped products, such as containers of body wash and a washing aid or other commercial items, packaged together. Therefore, the invention may provide a marketing advantage for manufacturers wanting to sell coordinating, but disparately sized, products together.

This invention is an improvement over known wrap-around packages because it provides a sufficient area for markings or graphics, and also allows the products themselves to be viewed. Thus, manufacturers or retailers of products are not forced to rely solely on either the packaging or the product markings. This provides an advantage because the product markings may remain substantially the same, while the wrap-around packaging reflects sale pricing or seasonal marketing.

This invention solves the problems of displaying a product, such as a puff, washing aid or other accessory, while protecting it from damage or theft, through the use of a front panel that allows viewing of the product. An embodiment can include a product-receiving platform in a compartment with an aperture of sufficient size to display the puff or accessory. The aperture provides an advantage because, although the wrap-around package substantially encloses the product, it can be viewed through the aperture. For smaller products, the product-receiving platform can raise the product to a sufficient height such that it may be seen through the aperture. Because the product is partially enclosed by the wrap-around package, even if the shrink-wrap enclosing the package is punctured, the product will not fall out.

Wrap-around packages according to one embodiment of the present invention can include a back panel connected to a front panel and a support panel. The front panel and the support panel can be adapted to at least partially enclose products contained within the package and the front panel and the support panel may be adhered to one another. This embodiment can also include two lateral side flaps extending from the front panel that fold toward the back panel to form a first central compartment. The front panel may be adapted to allow viewing of a product contained within the central compartment. The two side flaps, the support panel and the back panel can form second and third compartments.

In one embodiment, the front panel is T-shaped and the side flaps extend from the long portion of the "T". The front panel may also include an aperture adapted to allow viewing of a product contained with the central compartment.

In a particular embodiment of the invention, the wrap-around package can include a top panel connecting the front panel and the back panel. In another embodiment, the support panel may at least partially form a platform for displaying a product.

In another embodiment, the wrap-around package includes containers located within the second and third compartments and a washing aid or other accessory located within the central compartment. More particularly, the wrap-around package can be surrounded by shrink-wrap.

In another embodiment of the invention, the wrap-around packaging includes two central front and back panels; at least one end panel between the bottoms of the front central panel and the back central panel and separated from both central panels by scorelines; two side flaps, wherein each side flap extends laterally from the front central panel and is separated from the front central panel by a scoreline; a central compartment formed from the flaps, the front central panel and the back central panel; and second and third compartments formed by the flaps, the front central panel and the back central panel. The front central panel may be adapted to allow viewing of a product contained within the central compartment.

In one embodiment, the end panels include a top end panel located between the top ends of the front central panel and the back central panel.

In a particular embodiment, a bottom front end panel is separated from the bottom end panel by a scoreline and is adhered to the front central panel.

In another embodiment of the invention, the front central panel includes an opening.

In more particular embodiment, the central compartment contains a platform. In another embodiment, a washing aid or other accessory is placed on the platform.

In another embodiment of the invention, the package contains two containers and a washing aid or other accessory. In yet another embodiment of the invention, shrink-wrap surrounds the package.

The invention includes embodiment of blanks for forming wrap-around packages. The blanks have a base sheet having six scorelines to form seven panels. The base sheet includes a first panel for forming an elongated front panel that when formed is substantially perpendicular to a second panel; the second panel is located at the top of the structure; third and fourth panels of substantially the same size and shape for forming side panels extending laterally from the first panel and being substantially perpendicular to the second panel; a fifth panel forming a back panel that when formed is substantially perpendicular to the second panel and substantially parallel to the first panel; a sixth panel forming a bottom end panel that when formed is substantially perpendicular to the fifth panel and substantially parallel to the second panel; a seventh panel forming a bottom front end panel that when formed is substantially perpendicular to the sixth panel and is attached to the first panel, wherein the panels are folded to form a wrap-around package.

In another embodiment, the blank also includes an opening in the first panel. In a more particular embodiment, the blank has eighth and ninth panels forming a structure cut from the fifth and sixth panels, wherein the eighth panel when formed is substantially perpendicular to the fifth panel, and wherein the ninth panel when formed is substantially perpendicular to the eighth panel and the sixth panel and is attached to the seventh panel.

The invention also includes embodiments of methods for making wrap-around packages. The method includes printing data on a base sheet; forming cutout sections into appropriate sections of the base sheet; forming scorelines defining a plurality of panels, wherein a first panel defines an elongated front panel, a second panel defines a top panel, third and fourth panels define side panels, a fifth panel defines a back panel; a sixth panel defines a first portion of a bottom panel and a seventh panel defines a second portion of a bottom panel and provides a connection to the first panel; and applying adhesive to either the first panel or the seventh panel in order to secure the structure.

In a particular embodiment of the invention, eighth and ninth panels define a product receiving platform; and the method further comprises applying adhesive to the either the first panel or the ninth panel in order to secure the structure.

DETAILED DESCRIPTION OF SPECIFIC EMBODIMENTS OF THE INVENTION

This invention will now be described more fully with reference to the drawings, showing preferred embodiments of the invention. However, this invention can be embodied in many different forms and should not be construed as limited to the embodiments set forth.

Figure 1:
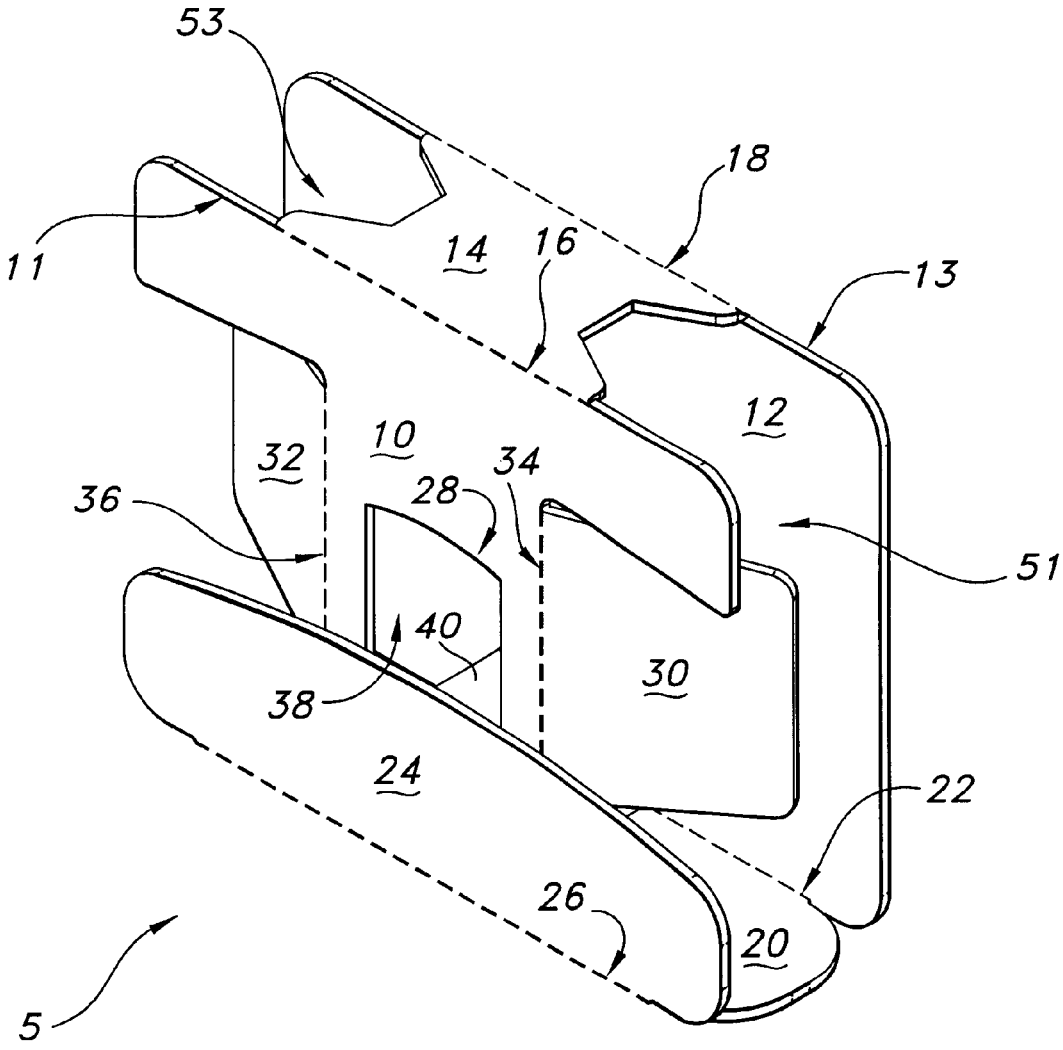
FIG. 1 is a perspective view of an erected wrap-around package according to one embodiment of the invention prior to the addition of products or shrink-wrap.

FIG. 1 shows a formed wrap-around package according to one embodiment of the invention devoid of its contents. The wrap-around package 5 comprises two central panels, a front central panel 10 and a back central panel 12. Although front central panel 10 is shown as a T-shaped panel, a T-shaped panel is not necessary. The panel may be curved or straight. It may be a simple elongated panel or it may be shaped like the letter I. Furthermore, back central panel 12 is not limited to the substantially square shape shown in FIG. 1. The back central panel 12 may be T-shaped, I-shaped, curved or straight. It may be substantially solid or alternatively, it may have cutouts. At an end of each of the central panels 10 and 12, there is at least one end panel separated from the central panels 10 and 12 by a scoreline.

In an embodiment with only one end panel (not shown), at the bottom ends 15 and 17 (shown in FIG. 2) of the front central panel 10 and the back central panel 12, a bottom end panel 20 spans the distance between the two central panels. Bottom end panel 12 is separated from back central panel 12 by scoreline 22. Front central panel 10 and back central panel 12 may be connected by a scoreline in order to more completely enclose the products within.

In an embodiment with two end panels, a top end panel 14 spans the distance between the top ends 11 and 13 of the front central panel 10 and the back central panel 12. Top end panel 14 is separated from front central panel 10 and back central panel 12 by scorelines 16 and 18 respectively.

Alternatively, as shown in FIG. 1, a bottom front end panel 24 wraps around to the front central panel 10. The bottom front end panel 24 is separated from the bottom end panel 20 by a scoreline 26. The bottom front end panel 24 may be adhered to the exterior of the front central panel 10.

The front central panel 10 may further comprise an aperture 28 through which a product may be viewed. The aperture 28 may be of a size sufficient to allow a portion of the product within to be viewed, but small enough to minimize the likelihood of the product falling out of the aperture 28.

Figure 2:
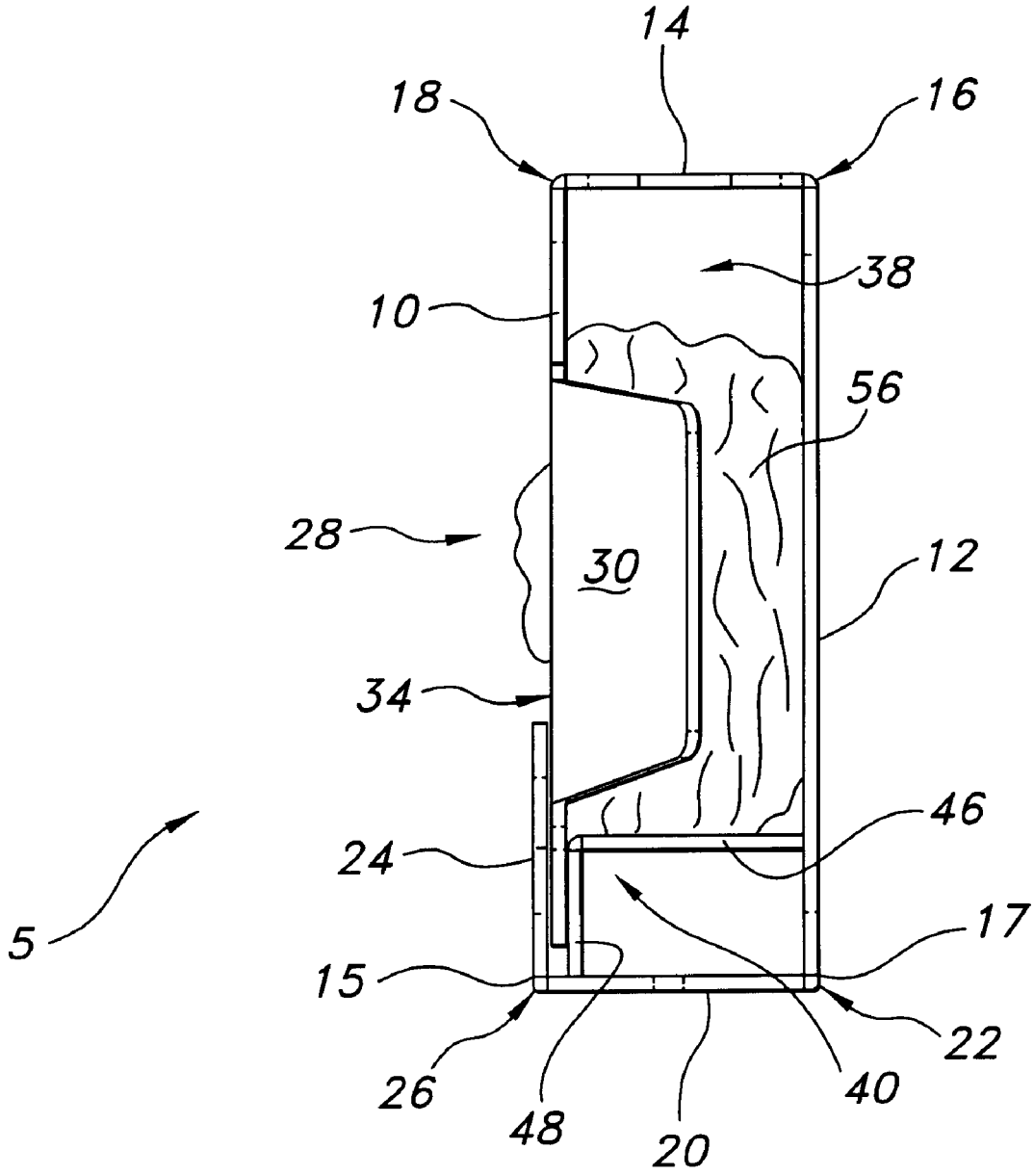
FIG. 2 is a side view of an erected wrap-around package according to one embodiment of the invention with a puff on the product-receiving platform in the compartment and without containers in the container-receiving portions.

Extending laterally from the front central panel 10 are a first side flap 30 and a second side flap 32. The first side flap 30 is separated from the front central panel 10 by a scoreline 34 and the second side flap 32 is separated from the front central panel 10 by a scoreline 36. When the first side flap 30 and the second side flap 32 are creased at scorelines 34 and 36 to extend toward the back central panel 12 (as shown in FIG. 2), front central panel 10, first side flap 30, second side flap 32, back central panel 12 and end panels 14 and 20 define a first central compartment 38. Although side flaps 30 and 32 are shown as substantially square, they may be of any shape to sufficiently retain the product inside the first central compartment. For example, they may be substantially circular, triangular, or trapezoidal.

The first central compartment 38 may further comprise a product-receiving platform 40, as shown in FIG. 2. The product-receiving platform 40 may be set between the front central panel 10 and the back central panel 12. Alternatively, the product-receiving platform 40 may extend upwardly from the bottom end panel 20. In one embodiment, the product-receiving platform 40 is a cutout from the back central panel 12 and the bottom end panel 20. The product-receiving platform 40 is separated from the back central panel 12 and the bottom end panel 20 by scorelines 42 and 44, respectively (shown in FIG. 4). Alternatively, the product-receiving platform 40 may be a separate structure that is inserted between the front central panel 10 and the back central panel 12.

Figure 4:
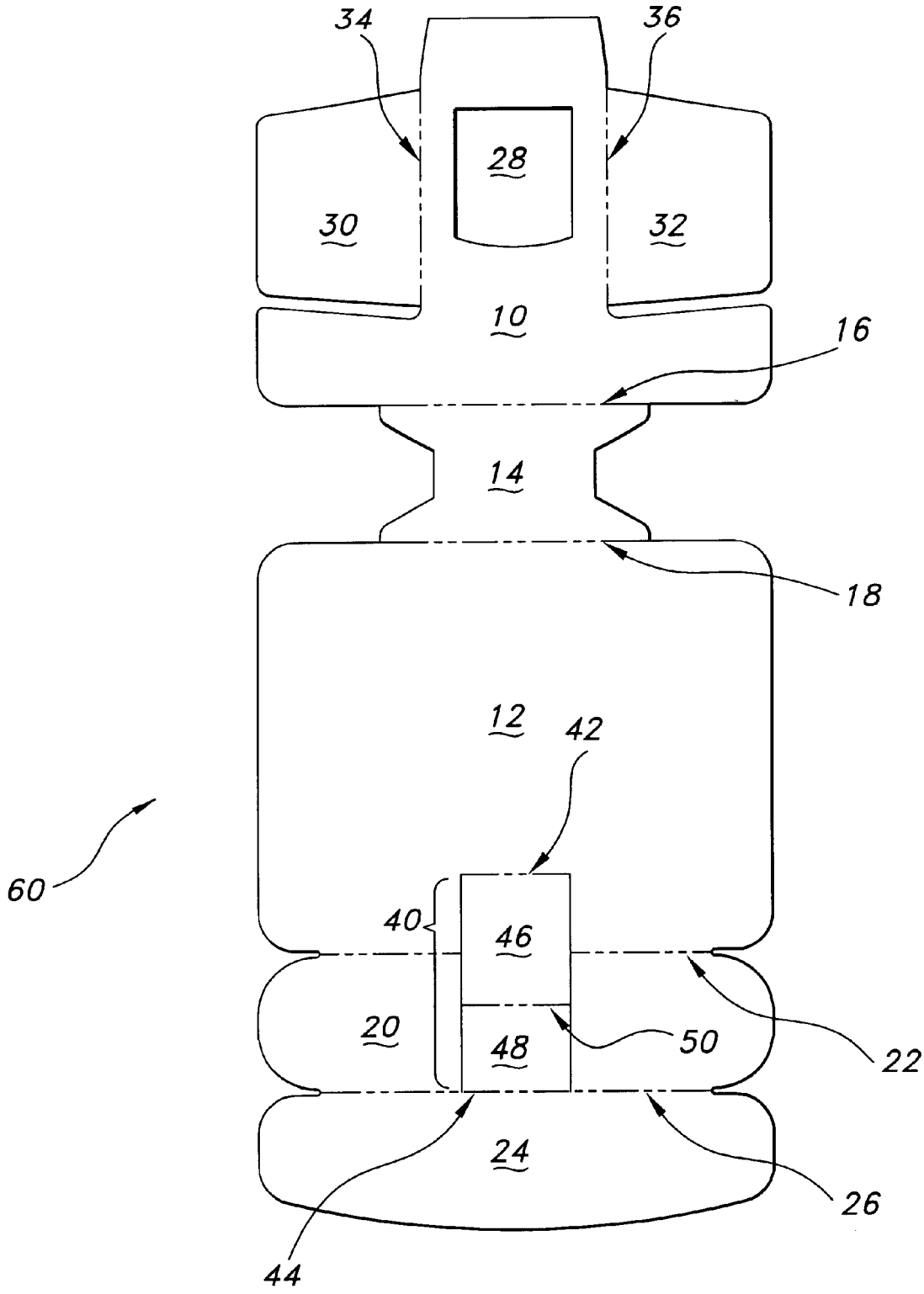
FIG. 4 is a top plan view of a carton blank that may be used to construct the wrap-around package of FIG. 1.

As shown in FIG. 4, the product-receiving platform 40 is divided into two sections 46 and 48 by a scoreline 50. A first section 46 extends laterally from one central panel to the opposite central panel. For example, where the product-receiving platform 40 is a cutout from the back central panel 12, a first section 46 of the product-receiving platform 40 extends laterally toward the front central panel 10. A second section 48 of the product-receiving platform 40 extends downwardly from the first section 46 to the bottom end panel 20. The second section 48 may be adhered to the interior of the front central panel 10.

As shown in FIG. 1, on either lateral end of the wrap-around package 5 of the invention are lateral compartments 51 and 53. For example, front central panel 10, first side flap 30, back central panel. 12, bottom end panel 20 and bottom front end panel 24 form a second lateral compartment 51. Front central panel 10, second side flap 32, back central panel 12, bottom end panel 20 and bottom front end panel 24 form a third lateral compartment 53. Top end panel 14 provides additional support between containers 52 and 54 (shown in FIG. 3). Containers 52 and 54 may be placed in lateral compartments 51 and 53. Unlike known wrap-around packages, containers 52 and 54 may be placed in the wrap-around package 5 from the sides without the need to insert the tops of containers 52 and 54 through a top aperture. This simplifies the packaging procedure and minimizes the risk that the wrap-around package 5 will be torn during packaging.

Figure 3:
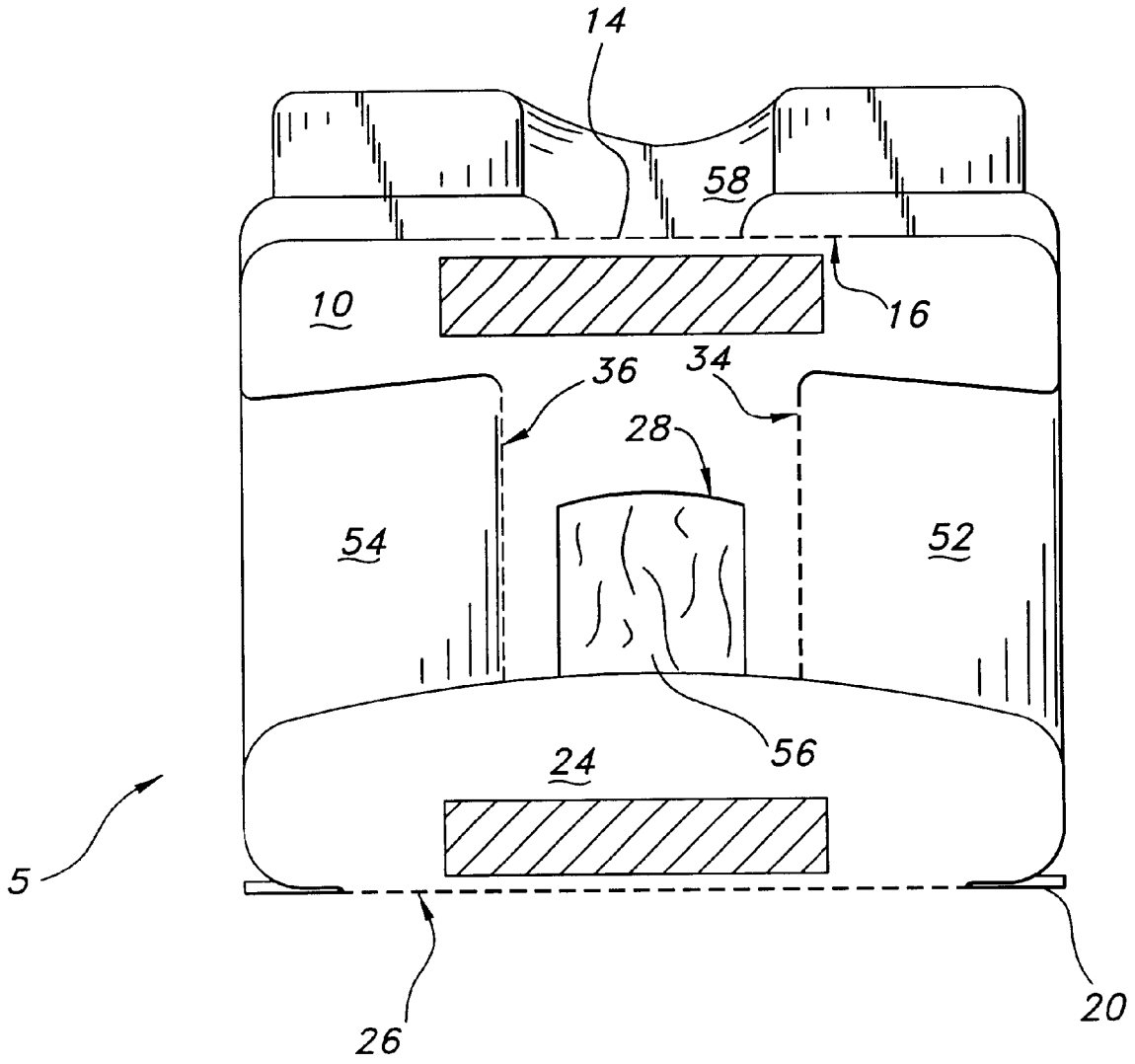
FIG. 3 is a front view of a wrap-around package according to one embodiment of the invention containing two bottles and a puff, the package wrapped in shrink-wrap.

As shown in FIG. 3, when prepared for sale to consumers, the wrap-around package 5 further comprises containers 52 and 54 located within the lateral compartments 51 and 53 (shown in FIG. 1). Because most consumers would prefer to purchase the contents of the containers with the related accessory, the wraparound package 5 may further comprise a related accessory located within the compartment 38. The accessory may be placed on the product-receiving platform 40 located inside the first central compartment 38. Also shown in FIG. 3, is the puff 56 or other accessory that can be seen by consumers through the aperture 28 in front central panel 10. Alternatively, the puff 56 or accessory may be placed on the product-receiving platform 40 in the first central compartment 38 (shown in FIG. 2), where it can be more readily seen by consumers through the aperture 28. Because the product-receiving platform 40 raises the accessory to the same height as the aperture 28 in the front central panel 10, a portion of it shows through the aperture 28.

Containers 52 and 54 of the invention may contain any type of personal washing product or cosmetic. The containers 52 and 54 may be filled with body wash and be packaged with a washing aid, such as a puff 56, as shown in FIG. 3. Alternatively, two containers 52 and 54 of body powder, baby wash, shampoo and conditioner, lotion, body oil or any other personal care item may be placed in the lateral compartments 51 and 53 and a powder puff, cosmetic applicator, washcloth, brush or any other personal care accessory may be placed on the product-receiving platform 40. The wrap-around package 5 of the invention is not limited to personal care products. For example, a container with car wash, a container with car wax and a sponge could be packaged in the wrap-around package 5. Food products may also be placed in wrap-around package 5. Milk, cereal and a bowl could be placed in the container receiving portions 51 and 53 and in the compartment 38. As those with skill in the art will understand, there are numerous possible combinations of containers and cleansing aids or other accessories.

The package of the invention may be made of a material such as paperboard, cardboard, or plastic. To provide added support and prevent the puff 56 and containers 52 and 54 from separating from the wrap-around package 5, the entire package may be enclosed in shrink-wrap 58 as shown in FIG. 3. As those skilled in the art will realize, paperboard is less supportive and less expensive than might otherwise be required if the design of the package did not rely on shrink-wrap for additional support. Additionally, the open design of the package allows the consumer to readily inspect the contents.

The present invention may be formed from a carton blank as shown in FIG. 4. A blank for forming a wrap-around package 5 comprises a base sheet 60 The base sheet 60 is comprised of a first panel 10 for forming an elongated front central panel 10 that when formed is substantially perpendicular to a second panel 14. The second panel is located at the top of the structure. Third and fourth panels 30 and 32 are of substantially the same size and shape and form side panels extending laterally from the first panel 10. The third and fourth panels 30 and 32 are movable and may be arranged to be substantially perpendicular to the second panel 14, thus forming a first central compartment 38 (as shown in FIGS. 1 and 2). A fifth panel 12 forms a back panel that when formed is substantially perpendicular to the second panel 14 and substantially parallel to the first panel 10. A sixth panel 20 forms a bottom end panel 20 that when formed is substantially perpendicular to the fifth panel 12 and substantially parallel to the second panel 14. When the panels are folded along scorelines 16, 18, 22, 34 and 36, they form a wrap-around package 5 according to one embodiment of the invention. The formed package is illustrated in FIG. 1.

Alternatively, a seventh panel 24 forms a bottom front end panel 24 that when formed is substantially perpendicular to the sixth panel 20 and is joined to the first panel 10. The seventh panel 20 may be joined to the first panel 10 with adhesive.

The blank may further comprise an aperture 28 in the first panel 10. As shown in FIG. 3, when the package is formed, the aperture 28 allows a washing aid or other accessory to be viewed by consumers. As described above, it may be desirable to raise the washing aid or accessory to improve the likelihood that a consumer will see it through the aperture 28. The platform 40 described above serves this function and may also be formed by the blank according to one embodiment of the invention. For example, the base sheet 60 may further comprise eighth and ninth panels 46 and 48 to form a platform 40. The panels 46 and 48 are cut from the fifth and sixth panels 12 and 20. To form the platform 40, the eighth panel 46 when formed is substantially perpendicular to the fifth panel 12, and the ninth panel 48 is substantially perpendicular to the eighth panel 46 and the sixth panel 20 and is joined to the first panel 10 with adhesive.

While the invention has been described in its preferred forms, many additions, modifications and deletions can be made thereto without departing from the spirit and scope of the invention. In other words, the particular embodiments of the invention described above are merely illustrative and are not the only embodiments possible. Those skilled in the art can readily identify additional embodiments and features of the invention that are within the scope of the appended claims.

What is claimed is:

1. A wrap-around package, comprising:

(a) a back panel connected to a front panel and a support panel, wherein the front panel and support panel are adapted to at least partially enclose products contained within the package and the front panel and support panel are adhered adhere to one another;

(b) the front panel comprising two lateral side flaps that fold toward the back panel to form a central compartment, the front panel being adapted to allow viewing of a product contained within the central compartment, wherein the two side flaps, support panel and back panel form second and third compartments.

2. The wrap-around package of claim 1, wherein the back panel and front panel are connected by a top panel.

3. The wrap-around package of claim 1, wherein the support panel at least partially forms a platform for displaying a product.

4. The wrap-around package of claim 1, wherein the front panel is T-shaped and the two side panels extend from the long portion of the "T".

5. The wrap-around package of claim 1, wherein the front panel has an aperture adapted to allow viewing of a product contained within the central compartment.

6. The wrap-around package of claim 1 further comprising containers of body wash or liquid soap in the second and third compartments and a washing aid or other accessory located within the central compartment.

7. The wrap-around package of claim 6 further comprising shrink-wrap surrounding the package.

8. A wrap-around package comprising (a) two central panels, wherein one central panel is located in a front and one central panel is located in a back;

(b) at least one end panel between the bottom ends of the front central panel and the back central panel and separated from both central panels by a scoreline;

(c) two flaps, wherein each extends laterally from the front central panel and is separated from the front central panel by a scoreline;

(d) a central compartment formed from the flaps, the front central panel and the back central panel, wherein the front central panel is adapted to allow viewing of a product contained within the central compartment; and (e) second and third compartments formed by the flaps, the front central panel and the back central panel.

9. The package of claim 8 further comprising a top end panel between the top ends of the front central panel and the back central panel and separated from both central panels by scorelines.

10. The package of claim 8 wherein a bottom front end panel is separated from the bottom end panel by a scoreline and is adhered to the front central panel.

11. The package of claim 8 wherein the front central panel further comprises an aperture.

12. The package of claim 8 further comprising a platform disposed between the front central panel and the back central panel.

13. The package of claim 12 wherein the platform is formed from the back central panel and the bottom end panel and is separated from the panels by scorelines.

14. The package of claim 13 wherein the platform is divided into two panels, a first panel extending laterally from the back central panel to the front central panel and a second panel separated from the first panel by a scoreline and extending downwardly from the first panel to the bottom end panel and wherein the second panel is adhered to the front central panel.

15. The package of claim 8 further comprising at least two containers of body wash or liquid soap.

16. The package of claim 15 further comprising a washing aid or other accessory.

17. The package of claim 16 further comprising shrink-wrap surrounding the package.

18. A blank for forming a wrap-around package, the blank comprising:

a base sheet having six scorelines to form six panels, the base sheet comprising:

(e) a first panel for forming an elongated front panel that when formed is substantially perpendicular to a second panel; the second panel being located at a top of the structure;

(f) third and fourth panels of substantially the same size and shape for forming side panels extending laterally from the first panel and being movable;

(g) a fifth panel forming a back panel that when formed is substantially perpendicular to the second panel and substantially parallel to the first panel;

(h) a sixth panel forming a bottom end panel that when formed is substantially perpendicular to the fifth panel and substantially parallel to the second panel;

wherein the panels are folded to form a wrap-around package.

19. The blank of claim 18 further comprising a seventh panel forming a bottom front end panel that when formed is substantially perpendicular to the sixth panel and is attached to the first panel.

20. The blank of claim 18 further comprising an aperture in the first panel.

21. The blank of claim 18 further comprising eighth and ninth panels forming structure cut from the fifth and sixth panels, (a) wherein the eighth panel when formed is substantially perpendicular to the fifth panel, and (b) wherein the ninth panel when formed is substantially perpendicular to the eighth panel and the sixth panel and is attached to the first panel.

* * * * *